US005754990A

United States Patent [19]

Gurries, II

[11] Patent Number: 5,754,990

[45] Date of Patent: May 26, 1998

[54] EMERGENCY WASH STATION

[75] Inventor: Albert G. Gurries, II, Reno, Nev.

[73] Assignee: Haws Company, Sparks, Nev.

[21] Appl. No.: 707,002

[22] Filed: Sep. 3, 1996

[51] Int. Cl.[6] ..... A61H 33/00

[52] U.S. Cl. ..... 4/620; 239/590

[58] Field of Search ..... 4/620; 239/590, 239/543

[56] References Cited

U.S. PATENT DOCUMENTS

| | | | |
|---|---|---|---|
| 2,458,876 | 1/1949 | Rehn . | |
| 2,482,960 | 9/1949 | Benson . | |
| 2,910,064 | 10/1959 | Brangaitis . | |
| 2,999,248 | 9/1961 | Logan et al. . | |
| 3,413,660 | 12/1968 | Lagarelli et al. . | |
| 3,599,251 | 8/1971 | Wright . | |
| 3,629,876 | 12/1971 | Wright . | |
| 3,757,806 | 9/1973 | Bhaskar et al. . | |
| 3,925,829 | 12/1975 | Bost . | |
| 4,012,798 | 3/1977 | Liautaud . | |
| 4,363,146 | 12/1982 | Liautaud . | |
| 4,545,083 | 10/1985 | Searson . | |
| 4,592,390 | 6/1986 | Boyd . | |
| 5,008,963 | 4/1991 | Stein . | |
| 5,530,972 | 7/1996 | Tanner | 4/620 |

FOREIGN PATENT DOCUMENTS

| | | |
|---|---|---|
| 661879 | 4/1963 | Canada . |
| 1325509 | 6/1962 | France . |

*Primary Examiner*—Charles E. Phillips

*Attorney, Agent, or Firm*—Kelly Bauersfeld Lowry & Kelley, LLP

[57] ABSTRACT

An emergency wash station is provided for flushing irritants from the eyes and face of an individual, particularly such as person working in a laboratory or industrial environment. The wash station comprises a basin with a pair of upstanding flow risers disposed therein and having spray heads at their upper ends. An actuator valve is adapted for movement to an open position to supply water for flow upwardly through the flow risers and spray heads. The flow risers each include a flow conduit leading to the associated spray head, in combination with at least one blind-end passage, to achieve more rapid initial delivery of water to the spray heads when the actuator valve is opened.

11 Claims, 2 Drawing Sheets

EMERGENCY WASH STATION

BACKGROUND OF THE INVENTION

This invention relates generally to emergency wash equipment for flushing irritants from the eyes and/or face of an individual, particularly such as a person working in an industrial or laboratory environment. More specifically, this invention relates to an improved wash station of relatively simplified construction, and designed to provide more rapid initial delivery of a flushing water flow upon initial actuation.

Emergency wash stations are generally known in the art for use in flooding the eyes and/or face of a person with a substantial flushing flow of fresh water. Such stations are commonly used in industrial and/or laboratory environments wherein irritants such as liquid or solid chemicals, fumes, and other toxic substances are present. The wash station typically includes one or more spray nozzles or spray heads for passage of fresh water to flush irritants which may have contacted the eyes and/or face of a person. An easily operated valve mechanism is normally provided to faciliate water supply connection to the spray heads, and a drain basin is normally present to collect and drain the flush water and accumulated contaminants.

The present invention relates to a simplified and improved emergency wash station constructed from a relatively small number of easily assembled components, and further including means for providing a faster initial flushing flow of water.

SUMMARY OF THE INVENTION

In accordance with the invention, an improved emergency wash station provides a rapid initial flushing flow of water to flush irritants from the eyes and/or face of a person.

The wash station comprises a bowl-shaped basin having a pair of upstanding flow risers disposed therein with spray heads mounted at the upper ends of said flow risers for delivering a controlled flushing flow of water in a generally upward direction over the basin. The lower ends of the flow risers are coupled by a supply manifold to a water supply line which includes a control valve adapted for emergency actuation by means of a push flag or the like to supply water through the flow risers to the spray heads. A flow control unit is desirably provided along the water supply line to maintain water pressure at a substantially constant level, and thereby assure a substantially uniform flush flow spray pattern.

Each flow riser incorporates a flow conduit for coupling the associated spray head with the supply manifold, in combination with at least one blind-end passage which opens to the supply manifold. With this geometry, upon initial water supply to the emergency wash station, the water flow passes through the supply manifold and flows into the flow risers. The blind-end passages effectively trap air therein to prevent significant water flow into the blind-end passages, thereby directing the initial water flow for delivery through the flow conduits to the spray heads. This results in a significantly faster water flow through the flow risers and faster initial delivery of the flush flow to the eyes and/or face of the person.

In accordance with further aspects of the invention, the bowl-shaped basin and flow risers disposed therein are conveniently formed with a unitary construction, preferably as a one-piece plastic molding with a recessed lower cavity defining a portion of the supply manifold. A second component in the form of an open-sided manifold member, also adapted for unitary plastic molding, is provided to fit over and close the lower cavity in the basin, and to provide an inlet fitting for convenient connection to the water supply line. The manifold member incorporates an elbow segment formed for removable mounting of the flow control unit.

Other features and advantages of the present invention will become more apparent from the following detail description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
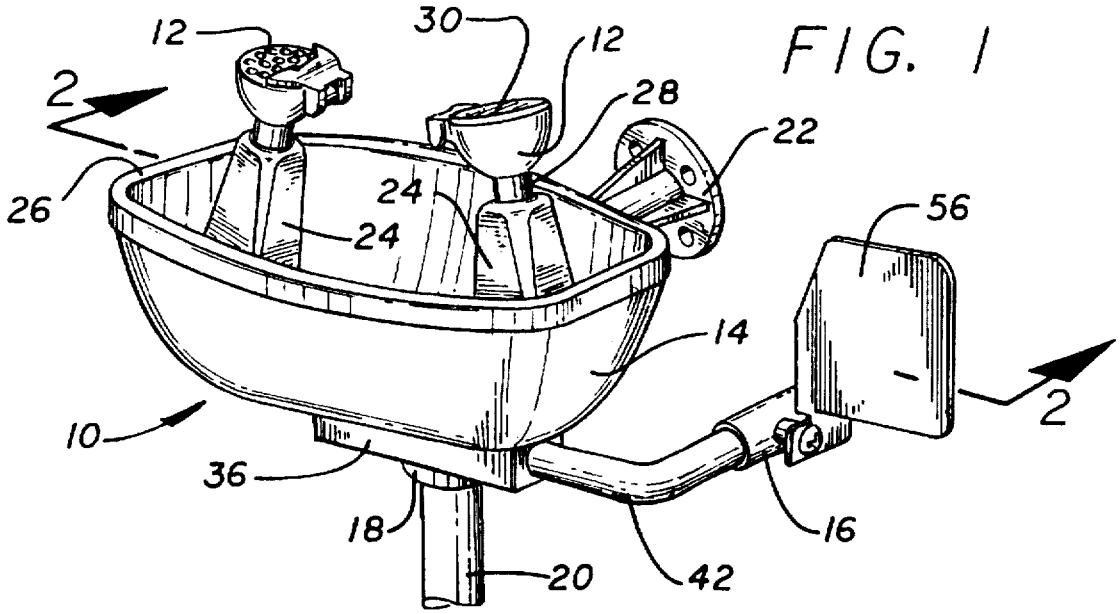
FIG. 1 is a fragmented perspective view illustrating an emergency wash station embodying the novel features of the invention.

As shown in the exemplary drawings, an improved emergency wash station referred to generally in FIG. 1 by the reference numeral 10 is provided for flushing irritants such as chemicals or other toxic substances from the eyes and/or face of an individual. The wash station 10 generally comprises a pair of spray heads 12 disposed over a bowl-shaped drain basin 14 and adapted for emergency connection to a supply of fresh water upon operation of an actuator valve 16. In accordance with the invention, the improved wash station 10 has a relatively simple and cost-efficient construction which is designed to achieve faster initial water flow to the spray heads 12 when the valve 16 is opened.

Figure 2:
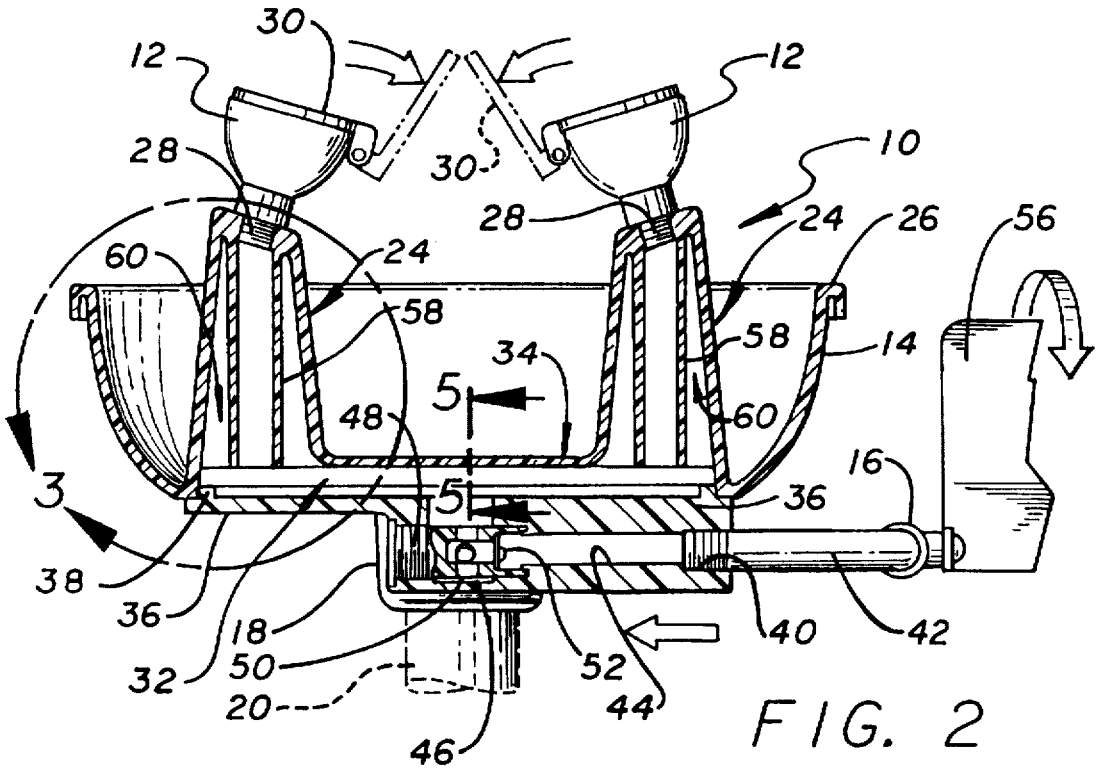
FIG. 2 is an enlarged fragmented transverse vertical sectional view taken generally on the line 2—2 of FIG. 1.

As shown generally in FIGS. 1 and 2, the bowl-shaped basin has an upwardly open geometry defining a lower floor and an upwardly projecting side wall for receiving and collecting water for subsequent flow through a drain collar 18 and appropriate drain tailpiece 20 to a suitable drain site. The basin 14 is adapted for mounting onto a wall (not shown) by means of a mounting bracket 22 or the like, although it will be understood that other mounting positions and structures may be provided. A pair of flow risers 24 extend upwardly from the floor of the basin 14 in spaced-apart relation and terminate with upper ends disposed at least slightly above a basin rim 26. The flow risers 24 are suitably configured at their upper ends for connection to the spray heads 12, as by thread-in reception of mounting nipples 28 on the spray heads. The illustrated spray heads 12 include hinged flip-off caps 30 for normally covering and protecting the spray heads when the emergency wash station is not in use. The flip-off caps 30 are designed to pop open automatically, when water is supplied through the flow risers 24 to the spray heads 12. Alternative spray head geometries and related flip-off or pop-off cap styles will be apparent to persons skilled in the art.

Figure 5:
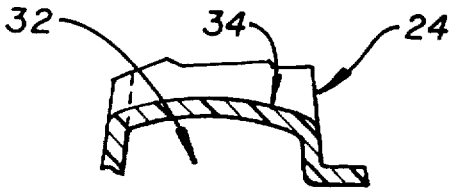
FIG. 5 is an enlarged fragmented vertical sectional view taken generally on the line 5—5 of FIG. 2.

In accordance with one aspect of the invention, the basin 14 and the flow risers 24 are formed, together with the drain collar 18, as a single unitary component constructed from molded plastic or the like. In this regard, the lower end of the flow risers 24 are in open flow communication with an open-sided cavity 32 recessed or inset into the underside of the basin 14. As shown best in FIG. 5, the shape of the basin portion which extends between the two flow risers 24 is preferably arched upwardly, to define an upwardly convex profile as depicted by arrow 34, to define the recessed cavity 32 in common flow communication with both flow risers 24.

A manifold member 36 is provided for assembly with the basin 14, in a manner which closes the underside cavity 32 to define a supply manifold into which fresh water flows when the actuator valve 16 is opened. The manifold member 36, which is also desirably constructed as a unitary plastic molding, includes a peripheral ridge 38 for mated reception into the underside of the basin 14, with an appropriate adhesive connection providing a sealed assembly therebetween.

The manifold member 36 includes an inlet fitting 40 for quick and easy connection to a water supply line 42 along which the actuator valve 16 is installed. The manifold inlet fitting 40 permits water flow through a short passage 44 to an elbow segment 46 (FIG. 2) which turns upwardly in flow communication with the supply manifold cavity 32. This elbow segment 46 is open-ended and includes a threaded access port 48 to permit removable mounting of a cartridge-type flow control unit 50 which regulates water pressure downstream therefrom to a selected and substantially constant level. Such flow control units 50 are generally known in the art and typically include a resilient flow control washer of the general type described in U.S. Pat. No. 4,592,390. The flow control unit 50 may also include a strainer screen 52. Importantly, the flow control unit 50 is positioned for easy access and periodic removal for appropriate maintenance and/or replacement.

The actuator valve 16 mounted along the water supply line 42 includes a conventional valve body mounted in line with the water supply line 42 and incorporating an appropriate valve member such as a ball valve or the like for selectively opening and closing the valve body to water flow passage. A push flag 56 or the like is rotatably mounted on the valve body and is adapted for rapid pivotal movement through a quarter-turn increment to open the valve in an emergency situation.

When the actuator valve 16 is open, water under pressure flows through the supply line 42 and the manifold member 36 into the supply manifold cavity 32. From the cavity 32, the water flows further in an upward direction through both flow risers 24, and the associated spray heads 12, to provide a flush flow for flushing irritants from the eyes and/or face of a person. Flush water is collected by the basin 14 for drain, as previously described. In accordance with one aspect of the invention, splashing of water falling into the basin is minimized by the arched, upwardly convex profile of the basin floor portion 34 extending between the flow risers.

Figure 3:
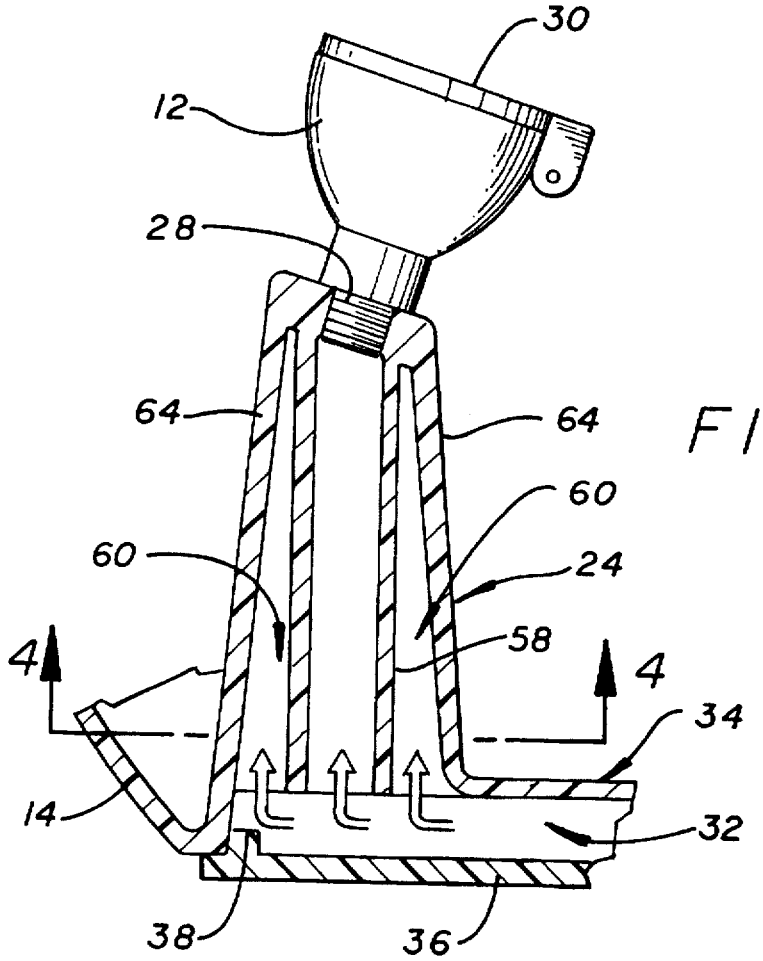
FIG. 3 is a further enlarged fragmented vertical sectional view corresponding generally with the encircled region 3 of FIG. 2.
Figure 4:
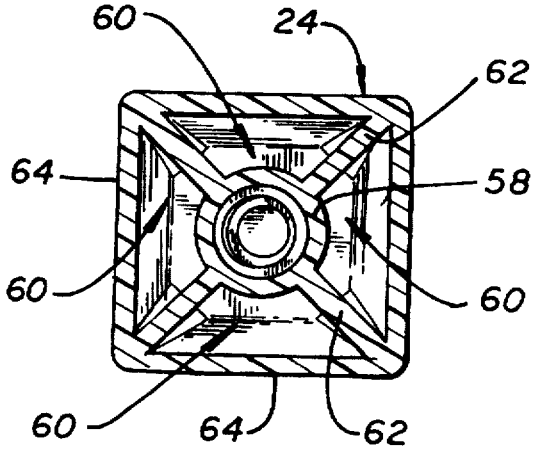
FIG. 4 is a horizontal sectional view taken generally on the line 4—4 of FIG. 3.

The flow risers 24 are specifically designed to achieve a relatively faster initial supply of the flush water flow to the spray heads, thereby achieving faster initial flushing of irritants from the eyes and/or face of a patient using the emergency wash station. In this regard, as shown in FIGS. 2–4, each flow riser 24 includes a relatively narrow central flow conduit or chimney 58 having a lower open end in flow communication with the manifold cavity 32, and an upper end leading to the associated spray head 12. This narrow flow conduit 58 is surrounded by one or more blind-end passages 60 with lower ends open to the manifold cavity 32 and blind or closed upper ends. FIG. 4 shows a series of these blind-end passages 60, with the central flow conduit 58 being supported centrally by radial webs 62 within an outer riser housing structure 64.

In use, when the actuator valve 16 is open for initial supply of water to the wash station, the water under pressure flows into the manifold cavity 32 and upwardly to the flow risers 24, including the narrow flow conduits 58 and the blind-end passages 60. When the water flow rises sufficiently to cover the lower ends of the conduits 58 and the blind-end passages 60, it is believed that air is trapped within the blind-end passages to prevent significant upward water flow therein. Instead, the water flow is confined to the narrower flow conduits 58 through which the water passes at a faster velocity to the spray heads. In a typical geometry and regulated pressure application, the combination of blind-end passages 60 and the narrower flow conduits 58 can deliver the flush flow to the spray heads 12 as much as 1–2 seconds faster than a standard configuration. Such faster initial spray, on initial opening of the actuator valve 16 can be critical in timely and effective removal of irritants and/or toxic substances from the eyes and/or face of a person using the wash station.

A variety of further modifications and improvements to the improved emergency wash station 10 of the present invention will be apparent to those skilled in the art. Accordingly, no limitation on the invention is intended by way of foregoing description and accompanying drawings, except as set forth in the appended claims.

What is claimed is:

1. An emergency wash station, comprising:

a drain basin;

at least one flow riser upstanding within said drain basin, said flow riser having an upper end with a spray head thereon and a lower end, said flow riser further defining a flow conduit for water flow from said lower end to said spray head, and at least one blind-end passage open at said lower end;

manifold means defining a manifold cavity in flow communication with said lower end of said flow riser; and water supply means for supplying a flow of water to said manifold cavity;

said drain basin and said flow riser comprising a unitary plastic molding, and further wherein said manifold means comprises a manifold member mounted on an underside of said drain basin and cooperating therewith to define said manifold cavity, said manifold member including a fitting for connection to said water supply means, and a flow passage extending between said fitting and said manifold cavity, said manifold member further including an access port for removable mounting of a flow control unit along said flow passage.

2. The emergency wash station of claim 1 wherein said drain basin has an upper rim, said spray head on said flow riser being disposed at least slightly above said upper rim.

3. The emergency wash station of claim 1 wherein said at least one flow riser comprises a pair of flow risers upstanding within said drain basin, each of said flow risers having the lower end thereof in flow communication with said manifold cavity.

4. The emergency wash station of claim 3 wherein said drain basin includes a floor and an upwardly projecting outer side wall, said pair of flow risers projecting upwardly from said floor in spaced-apart relation, and further wherein a portion of said floor disposed between said flow risers has an upwardly arched convex configuration.

5. The emergency wash station of claim 1 wherein said water supply means includes a water supply conduit connected to said manifold cavity and valve means for selectively opening said water supply conduit to water flow.

6. The emergency wash station of claim 1 further including pressure control means for regulating the pressure of water supplied to said manifold cavity.

7. The emergency wash station of claim 1 wherein said flow control unit includes means for regulating the pressure of water supplied to said manifold cavity.

8. An emergency wash station, comprising:

a bowl-shape drain basin having a floor and an upwardly projecting outer side wall terminating at an upper rim;

a pair of flow risers upstanding from the floor of said basin in spaced-apart relation, each of said flow risers having an upper end and lower end, each of said flow risers further including an open flow conduit extending between said upper and lower ends and at least one blind-end passage open at said lower end;

manifold means defining a manifold cavity in common flow communication with said lower ends of said flow risers; and water supply means including an actuator valve for selectively supplying a flow of water to said manifold cavity;

said drain basin and said flow risers comprising a unitary plastic molding, and further wherein said manifold means comprises a manifold member mounted on an underside of said drain basin and cooperating therewith to define said manifold cavity, said manifold member including a fitting for connection to said water supply means, and a flow passage extending between said fitting and said manifold cavity, said manifold member further including an access port for removable mounting of a flow control unit along said flow passage.

9. The emergency wash station of claim 8 wherein said upper ends of said flow risers are disposed at least slightly above said basin rim.

10. The emergency wash station of claim 8 further including spray heads mounted at the upper ends of said flow risers, said spray heads being disposed at least slightly above said basin rim.

11. The emergency wash station of claim 8 wherein a portion of said floor disposed between said flow risers has an upwardly arched convex configuration.

* * * * *